US011365638B2

(12) United States Patent
Williamson et al.

(10) Patent No.: US 11,365,638 B2
(45) Date of Patent: Jun. 21, 2022

(54) TURBINE BLADE AND CORRESPONDING METHOD OF SERVICING

(71) Applicant: Siemens Energy Global GmbH & Co. KG, Munich (DE)

(72) Inventors: Stephen Williamson, McAdenville, NC (US); Nan Jiang, Charlotte, NC (US)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 194 days.

(21) Appl. No.: 16/638,260

(22) PCT Filed: Aug. 14, 2017

(86) PCT No.: PCT/US2017/046694
§ 371 (c)(1),
(2) Date: Feb. 11, 2020

(87) PCT Pub. No.: WO2019/035802
PCT Pub. Date: Feb. 21, 2019

(65) Prior Publication Data

US 2020/0240276 A1 Jul. 30, 2020

(51) Int. Cl.
*F01D 5/20* (2006.01)
*F01D 5/18* (2006.01)

(52) U.S. Cl.
CPC ..... *F01D 5/20* (2013.01); *F01D 5/18* (2013.01); *F05D 2230/80* (2013.01); *F05D 2240/307* (2013.01); *F05D 2260/20* (2013.01)

(58) Field of Classification Search
CPC ..... F01D 5/20; F05D 2240/307
See application file for complete search history.

(56) References Cited

U.S. PATENT DOCUMENTS 6,595,749 B2 * 7/2003 Lee ..... B23P 6/005 415/173.1
7,972,115 B2 * 7/2011 Potier ..... F01D 5/20 416/228

(Continued)

FOREIGN PATENT DOCUMENTS

CN 101825002 A 9/2010
CN 205532726 U 8/2016

(Continued)

OTHER PUBLICATIONS

PCT International Search Report and Written Opinion dated Apr. 17, 2018 corresponding to PCT Application No. PCT/US2017/046694 filed Aug. 14, 2017.

*Primary Examiner* — Eldon T Brockman

(57) ABSTRACT

A turbine blade tip includes a squealer tip wall having a forward surface that is continuous with an outer surface of an airfoil pressure sidewall. A plurality of cooling channels are provided spaced apart along a contour of the squealer tip wall. Each cooling channel includes: an inlet configured for receiving a coolant from airfoil internal cavity; an upstream section including a closed channel extending from the inlet to the forward surface of the squealer tip wall; and a downstream section including an open channel formed by a slot on the forward surface of the squealer tip wall. The slot extends radially outward in a downstream direction so as to guide the coolant along the forward surface toward a radially outermost tip of the squealer tip wall.

13 Claims, 5 Drawing Sheets

(56) References Cited

U.S. PATENT DOCUMENTS

| | | | | |
|---|---|---|---|---|
| 8,777,572 | B2 * | 7/2014 | Cheong | F01D 5/20 416/97 R |
| 9,273,561 | B2 * | 3/2016 | Lacy | F01D 5/20 |
| 10,436,038 | B2 * | 10/2019 | Buhler | F01D 5/20 |
| 2002/0182074 | A1 | 12/2002 | Bunker | |
| 2002/0187044 | A1 * | 12/2002 | Lee | F01D 5/18 416/97 R |
| 2006/0088420 | A1 * | 4/2006 | Lee | B23P 6/007 416/235 |
| 2008/0175716 | A1 * | 7/2008 | Potier | F01D 11/10 416/97 R |
| 2010/0221123 | A1 | 9/2010 | Pal et al. | |
| 2011/0091327 | A1 | 4/2011 | Willett, Jr. | |
| 2012/0070308 | A1 * | 3/2012 | Naik | F01D 5/20 416/97 R |
| 2012/0189458 | A1 * | 7/2012 | Cheong | F01D 5/20 416/235 |
| 2014/0037458 | A1 * | 2/2014 | Lacy | F01D 5/20 416/97 R |
| 2014/0322028 | A1 | 10/2014 | Grohens et al. | |
| 2015/0078916 | A1 | 3/2015 | Bedrosyan et al. | |
| 2016/0186574 | A1 | 6/2016 | Weber et al. | |
| 2017/0159451 | A1 * | 6/2017 | Buhler | F01D 5/186 |

FOREIGN PATENT DOCUMENTS

| | | | |
|---|---|---|---|
| EP | 1650404 | A2 | 4/2006 |
| EP | 2952709 | A1 | 12/2015 |
| EP | 2780551 | B1 | 6/2016 |
| JP | 2011163123 | A | 8/2011 |
| JP | 5456192 | B1 | 3/2014 |

* cited by examiner

View II-II

View IV-IV

View VIII-VIII

TURBINE BLADE AND CORRESPONDING METHOD OF SERVICING

BACKGROUND

1. Field

The present invention relates to turbine blades for gas turbine engines, and in particular to turbine blade tips.

2. Description of the Related Art

In a turbomachine, such as a gas turbine engine, air is pressurized in a compressor section and then mixed with fuel and burned in a combustor section to generate hot combustion gases. The hot combustion gases are expanded within a turbine section of the engine where energy is extracted to power the compressor section and to produce useful work, such as turning a generator to produce electricity. The hot combustion gases travel through a series of turbine stages within the turbine section. A turbine stage may include a row of stationary airfoils, i.e., vanes, followed by a row of rotating airfoils, i.e., turbine blades, where the turbine blades extract energy from the hot combustion gases for providing output power.

Typically, a turbine blade is formed from a root at one end, and an elongated portion forming an airfoil that extends outwardly from a platform coupled to the root. The airfoil comprises a tip at a radially outward end, a leading edge, and a trailing edge. The tip of a turbine blade often has a tip feature to reduce the size of the gap between ring segments and blades in the gas path of the turbine to prevent tip flow leakage, which reduces the amount of torque generated by the turbine blades. The tip features are often referred to as squealer tips and are frequently incorporated onto the tips of blades to help reduce pressure losses between turbine stages. These features are designed to minimize the leakage between the blade tip and the ring segment.

However, due to extreme engine operating temperatures, squealer tip designs struggle to survive an entire service interval. High temperature oxidation and erosion of the squealer tip subsequently reduces engine power and efficiency.

SUMMARY

Briefly, aspects of the present invention provide a squealer tip design with improved cooling features.

According to a first aspect of the invention, a turbine blade is provided. The turbine blade comprises an airfoil comprising an outer wall formed by a pressure sidewall and a suction sidewall joined at a leading edge and at a trailing edge. The turbine blade includes a blade tip at a first radial end and a root at a second radial end opposite the first radial end for supporting the blade and for coupling the blade to a disc. The blade tip comprises a tip cap extending between the pressure sidewall and the suction sidewall, and a squealer tip wall extending radially outward of the tip cap and extending along a direction from the leading edge to the trailing edge. The squealer tip wall comprises a forward surface that is continuous with an outer surface of the pressure sidewall. The blade tip further comprises a plurality of cooling channels spaced apart along a contour of the squealer tip wall. Each cooling channel comprises: an inlet configured for receiving a coolant from airfoil internal cavity; an upstream section comprising a closed channel extending from the inlet to the forward surface of the squealer tip wall; and a downstream section comprising an open channel formed by a slot on the forward surface of the squealer tip wall. The slot extends radially outward in a downstream direction so as to guide the coolant along the forward surface toward a radially outermost tip of the squealer tip wall.

According to a second aspect of the invention, a method is provided for servicing a turbine blade to improve blade tip cooling. The turbine blade comprises an airfoil comprising an outer wall formed by a pressure sidewall and a suction sidewall joined at a leading edge and at a trailing edge. The turbine blade includes a blade tip at a first radial end and a root at a second radial end opposite the first radial end for supporting the blade and for coupling the blade to a disc. The blade tip comprises a tip cap extending between the pressure sidewall and the suction sidewall, and a squealer tip wall extending radially outward of the tip cap and extending along a direction from the leading edge to the trailing edge. The squealer tip wall comprises a forward surface that is continuous with an outer surface of the pressure sidewall. The method for servicing the blade comprises machining a plurality of cooling channels spaced apart along a contour of the squealer tip wall. Machining of each cooling channel comprises: machining a cooling channel inlet configured to be in fluid communication with airfoil internal cavity; machining an upstream section comprising a closed channel extending from the inlet to the forward surface of the squealer tip wall; and machining a downstream section comprising an open channel formed by a slot on the forward surface of the squealer tip wall. The slot extends radially outward in a downstream direction toward a radially outermost tip of the squealer tip wall.

BRIEF DESCRIPTION OF THE DRAWINGS

The invention is shown in more detail by help of figures. The figures show specific configurations and do not limit the scope of the invention.

DETAILED DESCRIPTION

In the following detailed description of the preferred embodiment, reference is made to the accompanying drawings that form a part hereof, and in which is shown by way of illustration, and not by way of limitation, a specific embodiment in which the invention may be practiced. It is to be understood that other embodiments may be utilized and that changes may be made without departing from the spirit and scope of the present invention.

Figure 1:
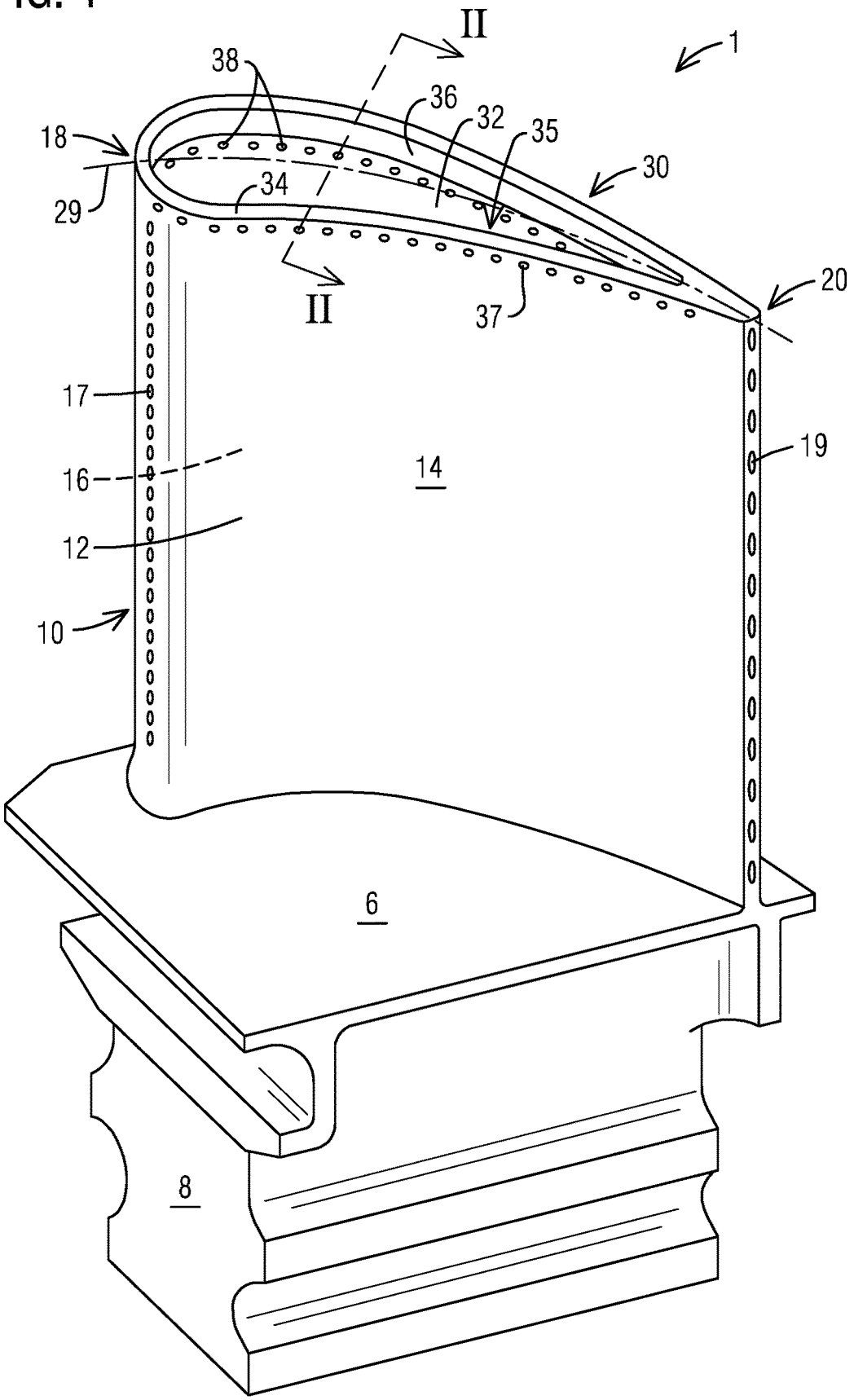
FIG. 1 is a perspective view of a turbine blade with a known type of squealer tip.

Referring to the drawings wherein identical reference characters denote the same elements throughout the various drawings, FIG. 1 illustrates a turbine blade 1. The blade 1 includes a generally hollow airfoil 10 that extends radially outwardly from a blade platform 6 and into a stream of a hot gas path fluid. A root 8 extends radially inward from the platform 6 and may comprise, for example, a conventional fir-tree shape for coupling the blade 1 to a rotor disc (not shown). The airfoil 10 comprises an outer wall 12 which is formed of a generally concave pressure sidewall 14 and a generally convex suction sidewall 16 joined together at a leading edge 18 and at a trailing edge 20, defining a camber line 29. The airfoil 10 extends from the root 8 at a radially inner end to a tip 30 at a radially outer end, and may take any configuration suitable for extracting energy from the hot gas stream and causing rotation of the rotor disc.

Figure 2:
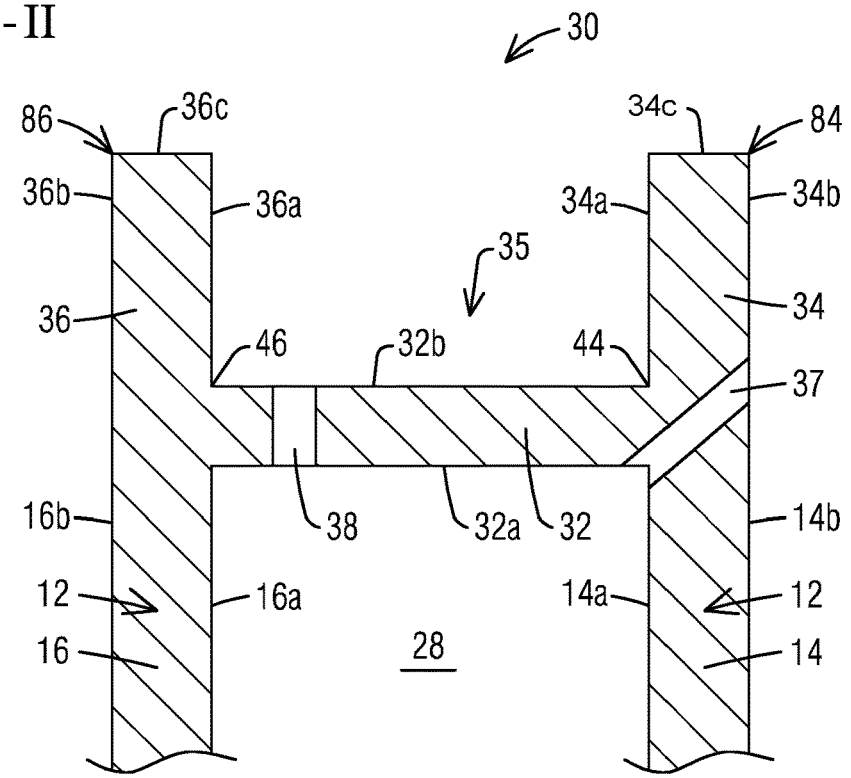
FIG. 2 is a schematic cross-sectional view along the section II-II in FIG. 1.

As shown in FIG. 2, the interior of the hollow airfoil 10 may comprise at least one internal cavity 28 defined between an inner surface 14*a* of the pressure sidewall 14 and an inner surface 16*a* of the suction sidewall 16, to form an internal cooling system for the turbine blade 1. The internal cooling system may receive a coolant, such as air diverted from a compressor section (not shown), which may enter the internal cavity 28 via coolant supply passages typically provided in the blade root 8. Within the internal cavity 28, the coolant may flow in a generally radial direction, absorbing heat from the inner surfaces 14*a*, 16*a* of the pressure and suction sidewalls 14, 16, before being discharged via external orifices 17, 19, 37, 38 into the hot gas path.

Particularly in high pressure turbine stages, the blade tip 30 may be formed as a so-called "squealer tip". Referring jointly to FIG. 1-2, the blade tip 30 may be formed of a tip cap 32 disposed over the outer wall 12 at the radially outer end of the outer wall 12. The tip cap 32 extends between the pressure and suction sidewalls 14 and 16 and has a pressure side edge 44 and a suction side edge 46. The tip cap 32 comprises a radially inner surface 32 facing the airfoil internal cavity 28 and a radially outer surface 32*b* facing a tip cavity 35. The blade tip 30 further comprises at least squealer tip wall, in this example, a pressure side squealer tip wall 34 and a suction side squealer tip wall 36, each extending radially outward from the tip cap 32 toward a radially outermost tip 84, 86 of the respective squealer tip wall 34, 36.

Referring to FIG. 2, the pressure side squealer tip wall 34 comprises an inner surface 34*a*, an outer surface 34*b* laterally opposite to the inner surface 34*a*, and a radially outwardly facing tip surface 34*c* located at the radially outermost tip 84 of the pressure side squealer tip wall 34. In this example, the outer surface 34*b* is parallel with the outer surface 14*b* of the pressure sidewall 14. The suction side squealer tip wall 36 comprises an inner surface 36*a*, an outer surface 36*b* laterally opposite to the inner surface 36*a*, and a radially outwardly facing tip surface 36*c* located at the radially outermost tip 86 of the suction side squealer tip wall 36. In this example, the outer surface 36*b* is parallel with the outer surface 16*b* of the suction sidewall 14. The pressure and suction side squealer tip walls 34 and 36 may extend substantially or entirely along the perimeter of the tip cap 32, such that the tip cavity 35 is defined between the inner surface 34*a* of the pressure side squealer tip wall 34 and the inner surface 36*a* of the suction side squealer tip wall 36. The blade tip 30 may additionally include a plurality of cooling holes 37, 38 that fluidically connect the internal cavity 28 with an external surface of the blade tip 30 exposed to the hot gas path fluid. In the shown example, the cooling holes 37 are formed through the pressure side squealer tip wall 34 while the cooling holes 38 are formed through the tip cap 32 opening into the tip cavity 35. Additionally or alternately, cooling holes may be provided at other locations at the blade tip 30.

In order to provide effective blade tip sealing capability and reduction of secondary flow losses, squealer tip walls may be configured as winglets to provide a more viable aerodynamic design. However, due to extreme engine operating temperatures, squealer tip winglet designs struggle to survive an entire service interval without an effective cooling scheme. High temperature oxidation and erosion of the squealer winglet subsequently reduces engine power and efficiency. Embodiments of the present invention provide a squealer winglet design with improved cooling features to survive high operating temperatures. In particular, the illustrated embodiments are direct toward improved film cooling on a pressure side squealer tip wall or winglet.

Figure 3:
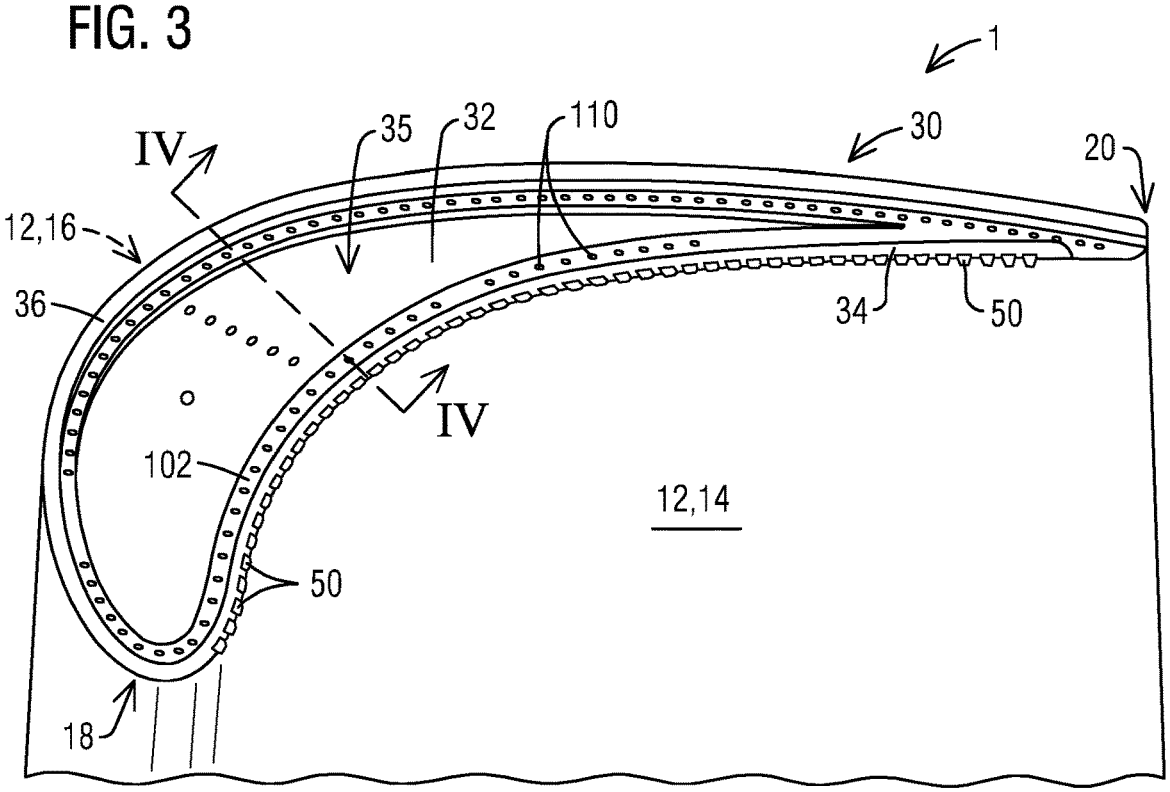
FIG. 3 is a perspective view of a portion of a turbine blade according to a first embodiment of the present invention.
Figure 4:
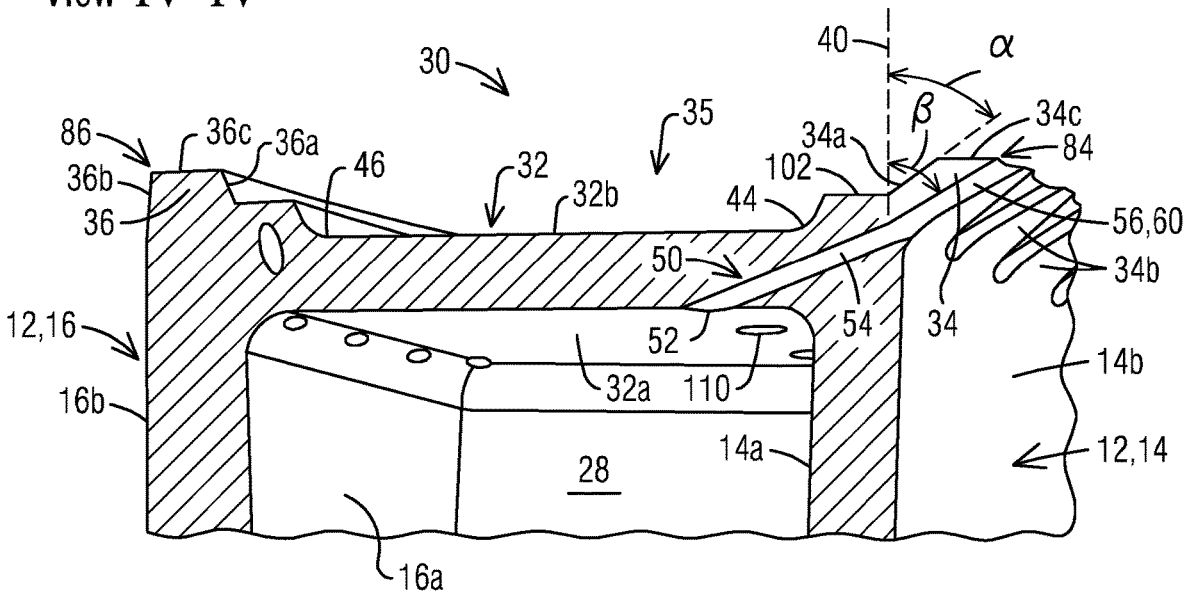
FIG. 4 shows a perspective sectional view along the section IV-IV in FIG. 3.

FIG. 3-6 illustrate a first exemplary embodiment of the present invention. This embodiment differs from the arrangement of FIG. 1-2 at least in the configuration of the pressure side squealer tip wall 36, which is designed as a winglet. As shown therein, the pressure side squealer tip wall or winglet 36 extends radially outward of the tip cap 32 and extends along a direction from the leading edge 18 to the trailing edge 20. The pressure side squealer tip wall 34 comprises an outer or forward surface 34*b* that is continuous with the outer surface 14*b* of the pressure side wall 14. The inner or aft surface 34*a* of the pressure side squealer tip wall 34 is adjacent to the tip cavity 35. The squealer tip wall 34 further comprises a radially outward facing tip surface 34*c* located at a radially outermost tip 84 of the squealer tip wall 34. The tip surface 34*c* has a forward edge 72 adjoining the forward surface 34*b* and an aft edge 74 adjoining the aft surface 34*a* of the squealer tip wall 34. As shown in FIG. 3, the pressure side squealer tip wall 34 may extend chord-wise at least along a portion of the pressure sidewall 14 in a direction from the leading edge 18 to the trailing edge 20. In accordance with aspects of the present invention, a plurality of cooling channels 50 are provided spaced apart along a contour of the squealer tip wall 34, as shown in FIGS. 3 and 4.

Figure 5:
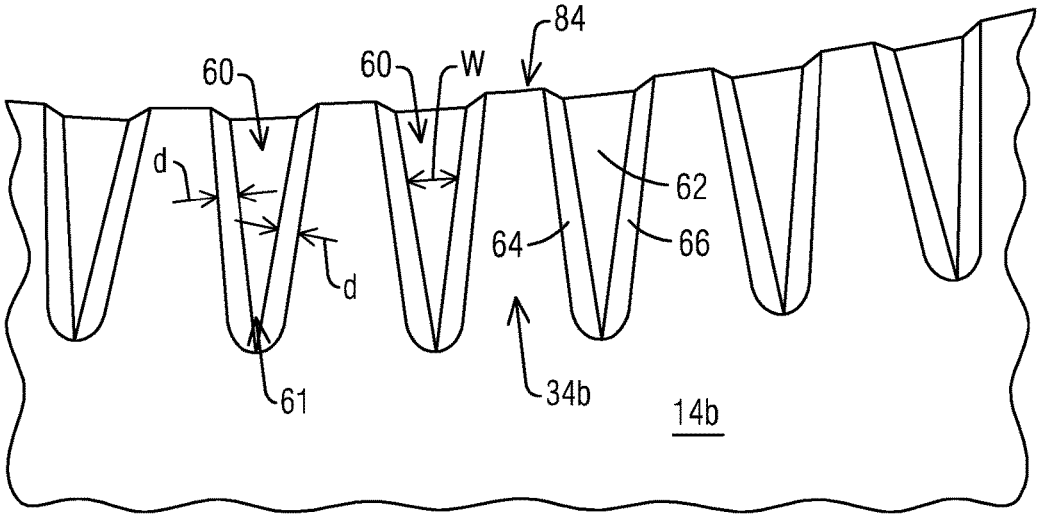
FIG. 5 is an enlarged perspective view, looking in a direction from the pressure side to the suction side, illustrating a first exemplary configuration of slots.

Referring in particular to FIG. 4, each cooling channel 50 is provided with an inlet 52 configured for receiving a coolant from an airfoil internal cavity 28. The coolant may comprise, for example, air bled from a compressor section, which is supplied to the internal cavity 28 via one or more supply passages located at the blade root. Each cooling channel 50 includes an upstream section 54 and a downstream section 56. The upstream section 54 is formed as a closed channel extending from the inlet 52 to the forward surface 34*b* of the squealer tip wall 34. The upstream section 54 may be machined as a through-hole of constant (typically cylindrical) flow cross-section. In the shown embodiment, the inlet 52 is formed on the radially inner surface 32*a* of the tip cap 32, whereby the through-hole extends from the radially inner surface 32*a* of the tip cap 32 to the forward surface 34*b* of the squealer tip wall 34. The downstream section 56 comprises an open channel formed by a slot 60 on the forward surface 34*b* of the squealer tip wall 34. The slot 60 comprises a slot inlet 61 (located on the forward surface 34*b*) connected to the upstream section 54, and extends radially outward in a downstream direction so as to guide the coolant along the forward surface 34*b* toward the radially outermost tip 84 of the squealer tip wall 34. Preferably, the slots 60 may extend at least up to the radially outermost tip 84, as shown in FIG. 4-6 (as also in FIG. 8-9).

The slots 60 may be machined parallel to the forward surface 34*b* of the squealer tip wall 34 and are configured to deliver cooling air directly to the squealer tip wall 34 and provide accurate control of film cooling coverage. Advantageously, each slot 60 may be configured as a diffuser-shaped break-out near the pressure side surface, to better control cooling air film coverage on the forward surface 34*b* of the squealer tip wall 34. To this end, as shown in FIG. 5, each slot 60 may have a diverging width W in the radially outward direction. In particular, in the illustrated embodiment, each slot 60 may be formed of a slot floor 62 flanked on opposite sides by a pair of slot sidewalls 64, 66. The width of the slot 60, defined by the width W of the slot floor, (i.e., the distance between the slot sidewalls 64, 66) increases in the radially outward direction. In one embodiment, each of the slot sidewalls 64, 66 is orthogonal to the slot floor 62. In alternate embodiments, the slot sidewalls 64, 66 may be inclined (non-orthogonal) to the slot floor 62.

Figure 6:
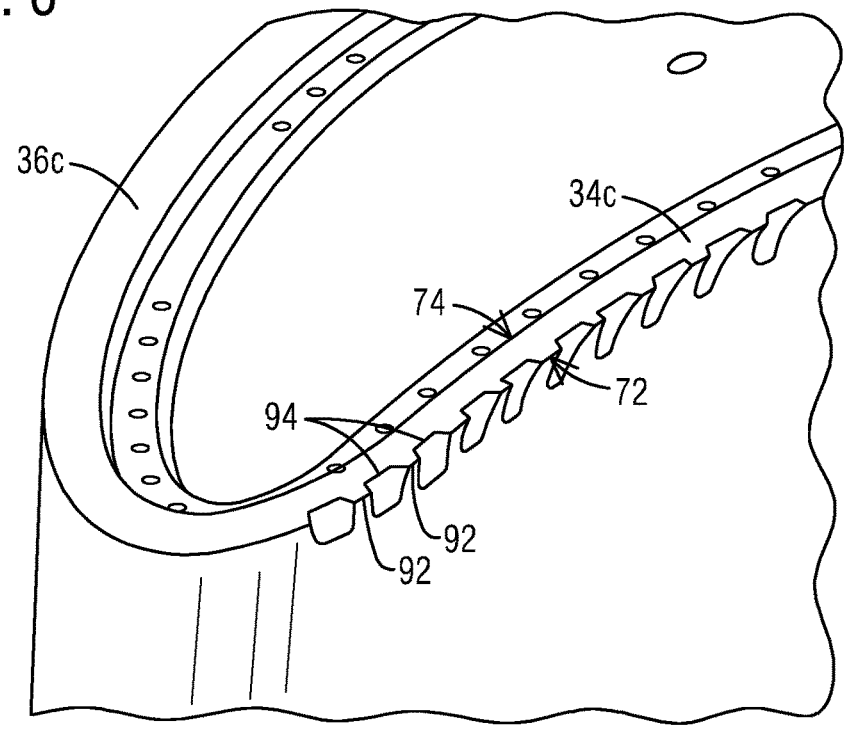
FIG. 6 is an enlarged perspective view of a portion of the blade tip of the turbine blade of FIG. 3, illustrating a squealer tip wall with a scalloped tip surface.

In the embodiment illustrated in FIG. 3-6, each slot 60, including the slot floor 62 and the slot sidewalls 64, 66, extends through the radially outermost tip 84 of the squealer tip wall 34, as shown in FIG. 4. Consequently, as best seen in FIG. 6, the radially outward facing tip surface 34*c* of the squealer tip wall 34 has a scalloped forward edge 72 defined by alternating peaks 92 and valleys 94. Thus, in the present embodiment, each slot 60 has two possible outlets for the cooling air, namely a first outlet exiting at the tip 84 (e.g., toward the stationary ring segment) and a second outlet exiting toward the pressure side of the airfoil. Extending the slots 60 all the way to the radially outermost tip 84 places a conduction path closest to the bare metal at the tip 84. Moreover, in the present embodiment, the cooling channel 50 "scarfs" into the pressure side squealer tip wall 34 to create a film cooling channel with consistent film coverage. The scarfing channels encourage the film to travel over the bare metal tip 84 in a uniform manner.

Figure 7:
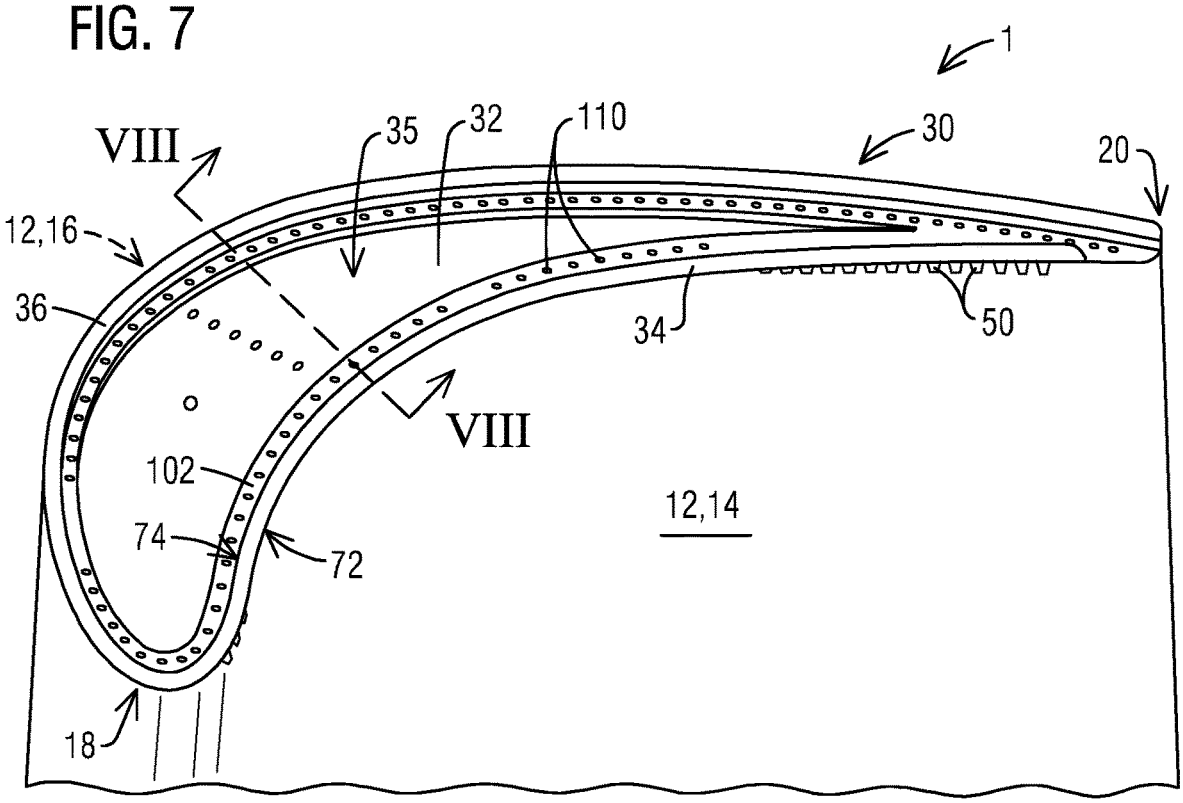
FIG. 7 is a perspective view of a portion of a turbine blade according to a second embodiment of the present invention.
Figure 8:
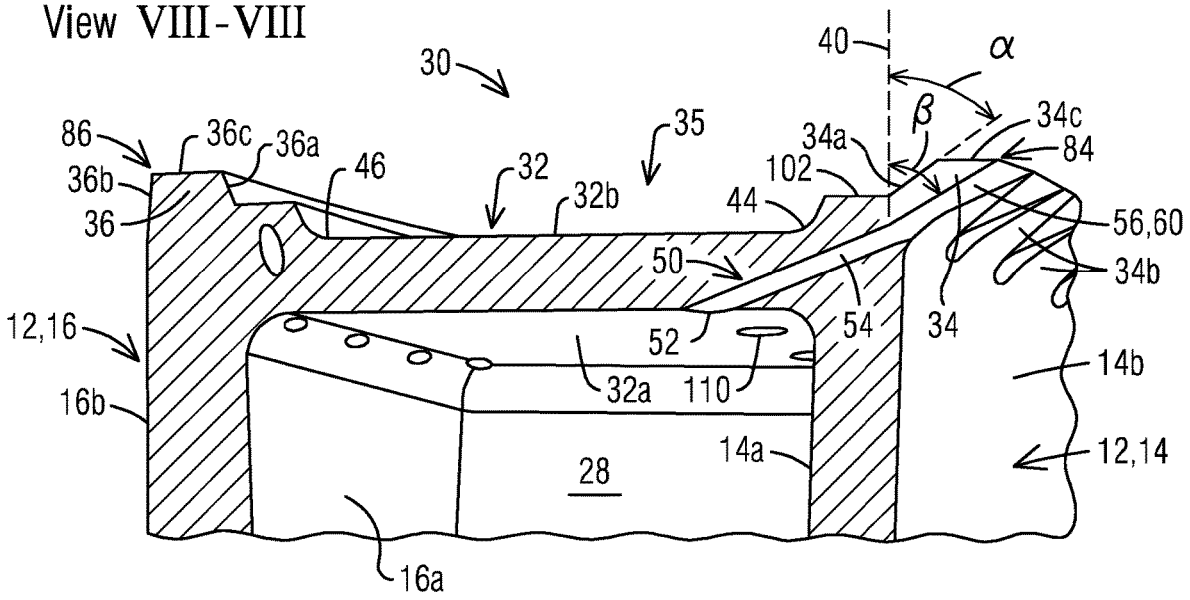
FIG. 8 shows a perspective sectional view along the section VIII-VIII in FIG. 7.
Figure 9:
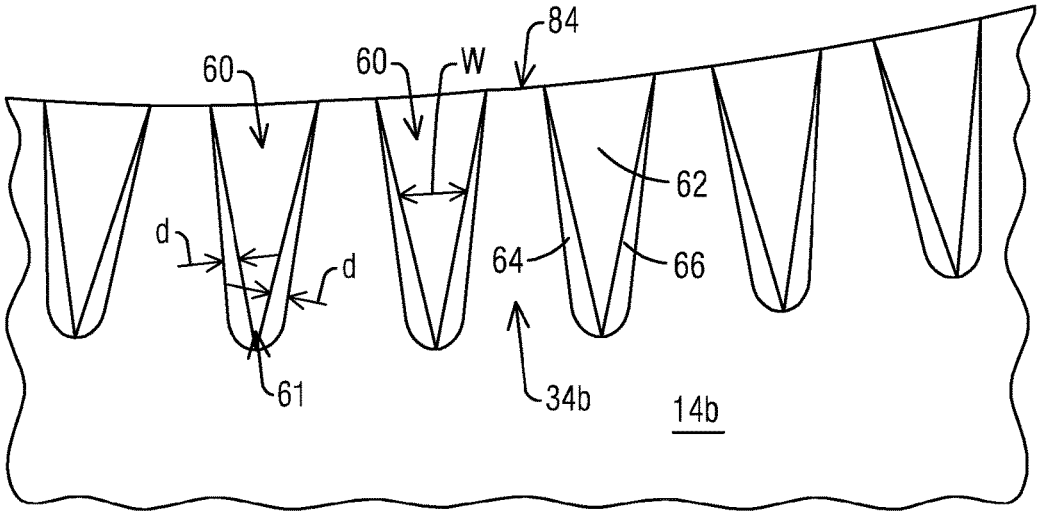
FIG. 9 is an enlarged perspective view, looking in a direction from the pressure side to the suction side, illustrating a second exemplary configuration of slots.

A second exemplary embodiment of the present invention is depicted in FIG. 7-9. This embodiment is similar to the embodiment of FIG. 3-6, except in the configuration of the slots 60. In this case, as shown in FIG. 8, each slot 60 extends up to the radially outermost tip 84 of the squealer tip wall 32, but does not extend through said tip 84. To this end, each slot 60 may have a depth, in a direction orthogonal to the forward surface 34*b* of the squealer tip wall 34, that tapers off in the radially outward direction. In the present embodiment, as shown in FIG. 9, each slot 60 comprises a slot inlet 61 (located on the forward surface 34*b*) connected to the upstream section 54. Each slot 60 is formed of a slot floor 62 flanked on opposite sides by a pair of slot sidewalls 64, 66. The width of the slot 60, defined by the width W of the slot floor, (i.e., the distance between the slot sidewalls 64, 66) increases in the radially outward direction, to form a diffuser break-out near the pressure side surface. Each of the slot sidewalls 64, 66 may be orthogonal to the slot floor 6. The slots sidewalls 64, 66 each have a depth D that tapers off in the radially outward direction to a substantially zero depth at the radially outermost tip 84 of the squealer tip wall 34. Consequently, as seen in FIG. 7, the radially outward facing tip surface 34*c* of the squealer tip wall 34 has a continuous (un-scalloped) forward edge 72. Thus, each slot 60 herein has only one possible outlet for the cooling air, exiting toward the pressure side of the airfoil.

In the embodiments illustrated above, the forward surface 34*b* of the squealer tip wall 34 is inclined with respect to a radial axis 40 toward a blade pressure side, as seen in FIG. 4 and FIG. 8. Such an inclination of the squealer tip wall 34 orients the cooling channels 50 away from the rotation and direction of rub of the squealer tip wall 34 against the surrounding stationary turbine component (e.g., ring segment), thereby reducing the risk of clogging. As an added feature, in one or more of the above-described embodiments, the aft surface 34*a* and the forward surface 34*b* may be oriented at respective angles (in relation to a radial axis 40) which vary independently along the chord-wise direction, such that the chord-wise variation of a first angle $\alpha$ between the aft surface 34*a* and the radial axis 40 is different from the chord-wise variation of a second angle $\beta$ between the forward surface 34*b* and the radial axis 40. The variably inclined squealer geometry may be optimized, for example, to provide a larger angle of inclination in regions where a high tip leakage flow has been identified.

In each of the embodiments illustrated above, the blade tip 30 comprises a radially outward step 102 at a pressure side edge 44 of the tip cap 32, as can be seen from FIG. 3-4 and FIG. 7-8. The squealer tip wall 34 extends radially outward from the step 102 to the radially outermost tip 84. The step 102 may extend chord-wise along a contour of the squealer tip wall 34. The step 102 may be beneficial in a number of ways. For example, the step feature within the squealer tip pocket provides adequate material for machining cooling channels into the cooling air supply core. As an added benefit, the step 102 may be provided with chord-wise spaced apart cooling holes 110 formed through the step 102 which are in fluid communication with an airfoil internal cooling system. The cooling holes 110 on the step 102, in combination with the cooling channels 50 through the squealer winglet 34, provides increased cooling of the blade tip 30.

In the embodiments shown in the drawings, the blade suction side is provided with a suction side squealer tip wall 36. In other embodiments, the blade suction side may be provided with additional or alternate tip features.

Aspects of the present invention may also be directed to a method for servicing a turbine blade to improve blade tip cooling, by machining a row of cooling channels along a forward side of a pressure side squealer tip wall, according to any of the illustrated embodiments.

While specific embodiments have been described in detail, those with ordinary skill in the art will appreciate that various modifications and alternative to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof.

The invention claimed is:

1. A turbine blade comprising:

an airfoil comprising an outer wall formed by a pressure sidewall and a suction sidewall joined at a leading edge and at a trailing edge, a blade tip at a first radial end and a root at a second radial end opposite the first radial end for supporting the blade and for coupling the blade to a disc, wherein the blade tip comprises:

a tip cap extending between the pressure sidewall and the suction sidewall, a squealer tip wall extending radially outward of the tip cap and extending along a direction from the leading edge to the trailing edge, the squealer tip wall comprising a forward surface that is continuous with an outer surface of the pressure sidewall, and a plurality of cooling channels spaced apart along a contour of the squealer tip wall, each cooling channel comprising:

an inlet configured for receiving a coolant from airfoil internal cavity, an upstream section comprising a closed channel extending from the inlet to the forward surface of the squealer tip wall, a downstream section comprising an open channel formed by a slot on the forward surface of the squealer tip wall, the slot extending radially outward in a downstream direction so as to guide the coolant along the forward surface toward a radially outermost tip of the squealer tip wall, wherein the slot extends through the radially outermost tip of the squealer tip wall, and wherein a forward edge of a radially outward facing tip surface of the squealer tip wall is defined by alternating peaks and valleys.

2. The turbine blade according to claim 1, wherein the slot has a diverging width in the radially outward direction.

3. The turbine blade according to claim 2, wherein the slot is formed by a slot floor flanked on opposite sides by a pair of slot sidewalls, wherein the width of the slot floor defined by a distance between the slot sidewalls increases in the radially outward direction.

4. The turbine blade according to claim 3, wherein the slot sidewalls are orthogonal to the slot floor.

5. The turbine blade according to claim 1, wherein the slot has a depth that tapers off in the radially outward direction to a substantially zero depth at the radially outermost tip of the squealer tip wall.

6. The turbine blade according to claim 1, wherein the closed channel forming the upstream section has a substantially constant flow cross-section.

7. The turbine blade according to claim 1, wherein the inlet is formed on a radially inner surface of the tip cap facing the airfoil internal cavity.

8. The turbine blade according to claim 1, wherein the slot extends at least up to the radially outermost tip of the squealer tip wall.

9. The turbine blade according to claim 1, wherein the blade tip comprises a radially outward step at a pressure side edge of the tip cap, wherein the squealer tip wall extends radially outward from said step to said radially outermost tip.

10. The turbine blade according to claim 9, wherein the blade tip further comprises a plurality of chord-wise spaced apart cooling holes formed through the step which are in fluid communication with an airfoil internal cooling system.

11. The turbine blade according to claim 1, wherein the forward surface of the squealer tip wall is inclined with respect to a radial axis toward a blade pressure side.

12. The turbine blade according to claim 1, wherein the squealer tip wall comprises an aft surface laterally opposite to the forward surface, wherein in relation to a radial axis, the aft surface and the forward surface are oriented at respective angles which vary independently along the chord-wise direction, such that the chord-wise variation of a first angle between the aft surface and the radial axis is different from the chord-wise variation of a second angle between the forward surface and the radial axis.

13. A method for servicing a turbine blade to improve blade tip cooling, the turbine blade comprising an airfoil comprising an outer wall formed by a pressure sidewall and a suction sidewall joined at a leading edge and at a trailing edge, a blade tip at a first radial end and a root at a second radial end opposite the first radial end for supporting the blade and for coupling the blade to a disc, wherein the blade tip comprises a tip cap extending between the pressure sidewall and the suction sidewall, and a squealer tip wall extending radially outward of the tip cap and extending along a direction from the leading edge to the trailing edge, the squealer tip wall comprising a forward surface that is continuous with an outer surface of the pressure sidewall, the method comprising:

machining a plurality of cooling channels spaced apart along a contour of the squealer tip wall, wherein machining each cooling channel comprises:

machining a cooling channel inlet configured to be in fluid communication with airfoil internal cavity, machining an upstream section comprising a closed channel extending from the inlet to the forward surface of the squealer tip wall, machining a downstream section comprising an open channel formed by a slot on the forward surface of the squealer tip wall, the slot extending radially outward in a downstream direction toward a radially outermost tip of the squealer tip wall, the slot extending through the radially outermost tip of the squealer tip wall, and a forward edge of a radially outward facing tip surface of the squealer tip wall defined by alternating peaks and valleys.

* * * * *